United States Patent [19]

Eachus et al.

[11] 4,055,735

[45] Oct. 25, 1977

[54] TOUCH SENSITIVE DEVICE

[75] Inventors: Joseph J. Eachus, Cambridge; Theodore S. Graff, Sudbury, both of Mass.

[73] Assignee: Honeywell Information Systems Inc., Waltham, Mass.

[21] Appl. No.: 625,272

[22] Filed: Oct. 23, 1975

[51] Int. Cl.[2] ..... H01H 1/02; H01H 13/70

[52] U.S. Cl. ..... 200/5 A; 200/159 B; 200/264; 340/365 C; 73/432 R

[58] Field of Search ..... 73/432 R; 340/365 A, 340/365 R, 365 C; 338/13, 68, 114, 99 R; 200/5 A, 159 B, 264; 307/116; 339/DIG. 3

[56] References Cited

U.S. PATENT DOCUMENTS

| | | | |
|---|---|---|---|
| 3,382,338 | 5/1968 | Arseneault et al. | 200/159 B |
| 3,437,973 | 4/1969 | Mabbett | 338/99 R |
| 3,503,031 | 3/1970 | Nyhus et al. | 338/99 R |
| 3,699,294 | 10/1972 | Sudduth | 340/365 A X |
| 3,749,859 | 7/1973 | Webb et al. | 200/159 B X |
| 3,758,733 | 9/1973 | DuRocher et al. | 200/159 R X |
| 3,860,771 | 1/1975 | Lynn et al. | 200/159 B |
| 3,862,382 | 1/1975 | Glaister et al. | 200/159 B |
| 3,944,766 | 3/1976 | Wood | 200/159 R X |
| 3,995,126 | 11/1976 | Larson | 200/5 A |

*Primary Examiner*—Richard C. Queisser
*Assistant Examiner*—Daniel M. Yasich
*Attorney, Agent, or Firm*—Ronald T. Reiling; Nicholas Prasinos; William F. White

[57] ABSTRACT

A touch sensitive device includes an arrangement of conductors in combination with a pressure sensitive electrically conductive material. The conductors appear in a cross-wire matrix imprinted on the top and bottom surfaces of a rigid printed circuit board. The pressure sensitive electrically conductive material is positioned over the cross-wire matrix of spaced electrical conductors. The resulting arrangement defines a plurality of touch sensitive locations which may be used for uniquely entering information in a data entry system.

11 Claims, 9 Drawing Figures

TOUCH SENSITIVE DEVICE

BACKGROUND OF THE INVENTION

This invention relates to touch sensitive devices. In particular, this invention relates to touch sensitive devices having a plurality of individual touch sensitive locations.

Touch sensitive devices having a plurality of individual touch sensitive locations are well known in the art. Heretofore, most of these devices have included complicated mechanical and electromechanical touch sensitive locations. Such locations have often not allowed for a close spacing within a confined area.

OBJECTS OF THE INVENTION

It is an object of this invention to provide an improved touch sensitive device.

It is another object of this invention to provide a touch sensitive device having relatively uncomplicated touch sensitive locations.

It is still another object of this invention to provide a touch sensitive device having a large plurality of closely spaced touch sensitive locations.

SUMMARY OF THE INVENTION

To achieve the above objects, a touch sensitive device having a plurality of individual touch sensitive locations is provided. The individual locations are physically defined by a cross-wire matrix of conductors imprinted on the top and bottom surfaces of a printed circuit board. Terminals connected to the conductors imprinted on the bottom surface extend upwardly to the top surface. A pressure sensitive variable resistance material is positioned over the top surface of the printed circuit board so as to define variable resistance paths between the conductors on the top surface and the terminals. Each variable resistance path defines a touch sensitive location which becomes highly conductive when the local portion of pressure sensitive variable resistance material is depressed.

BRIEF DESCRIPTION OF THE DRAWINGS

For a better understanding of the present invention, reference should be made to the accompanying drawings wherein.

DESCRIPTION OF THE PREFERRED EMBODIMENT

Figure 1:
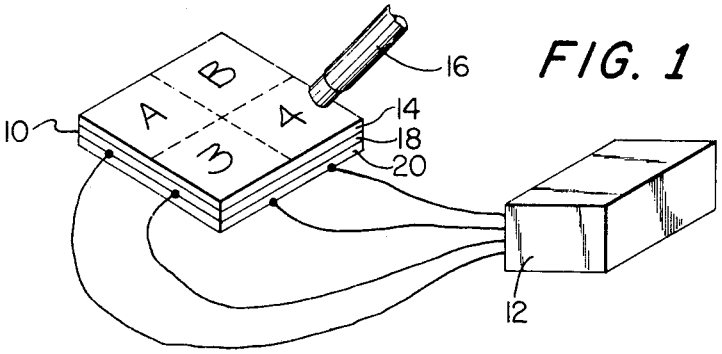
FIG. 1 is a schematic illustration of the touch sensitive device in combination with a location identification device.

Referring now to FIG. 1, a touch sensitive device 10 is electrically connected to a location identification device 12. The touch sensitive device 10 is seen to comprise three distinct elemental layers. A topmost layer 14 contains a 2 × 2 matrix of alpha-numerical characters. It is to be understood that any particular matrix location on the layer 14 can be depressed by a stylus 16 which can take the form of a pencil as shown. It is to be appreciated that the stylus can also include any means for applying pressure including a human finger. The topmost layer 14 is preferably a uniform material which is sufficiently flexible to be depressed locally while at the same time being firm enough to transmit only a local pressure from the stylus 16.

Beneath the topmost layer 14 is a layer 18 of electrically conductive material which has certain electrical properties to be described in detail hereinafter. Beneath the elastomer layer 18 is a rigid printed circuit board 20 having a set of conductive strips on the top and bottom surfaces thereof. The end terminals for the top and bottom printed circuit conductors are seen to be electrically connected to the location identification device 12.

Figure 2:
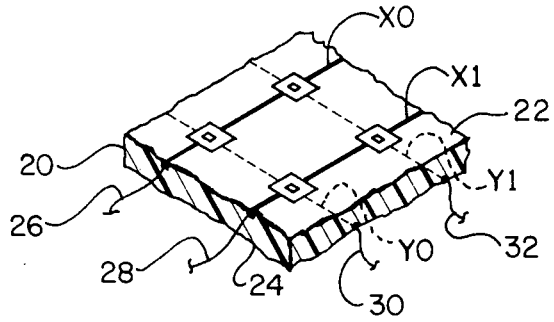
FIG. 2 schematically depicts the conductors and conductive means within the touch sensitive device of FIG. 1.

Turning now to FIG. 2 wherein the printed circuit board 20 is more particularly depicted, it is seen that a pair of parallel electrical conductors X0 and X1 are imprinted on a top surface 22. A second set of parallel conductors, Y0 and Y1, orthogonal to the first set, are imprinted on a bottom surface 24. Each set of parallel conductors are preferably strip conductors fabricated on the printed circuit board 20 by printed circuit techniques well known in the art. The end terminals of the various parallel conductors leave the printed circuit board 20 as extensions 26 through 32. These extensions run to the location identification device 12. It is to be understood that while only a pair of X and Y conductors have been shown, the number of conductors can be significantly increased according to the invention. For simplicity, the number of conductors have been limited to the illustrated pairs in each direction. It is to be noted that each of the X conductor strips imprinted on the top surface 20 includes an open rectangle such as 34 over each Y conductor which crosses thereunder. The open rectangle 34 forms part of an electroconductive means between the X conductor and the Y conductor passing underneath. This will be explained in detail hereinafter.

Figure 3:
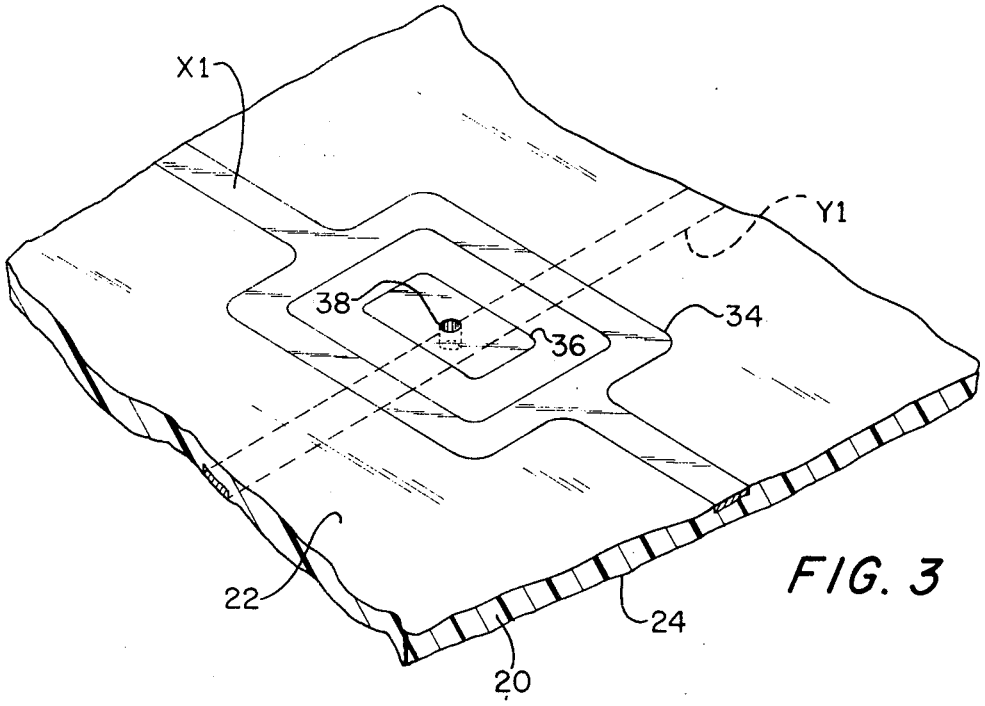
FIG. 3 is a detailed illustration of a particular conductive means.

Referring to FIG. 3 wherein the open rectangle 34 is illustrated in more detail and is in particular seen to completely encompass a pad 36 imprinted on the top surface 22. A plated-through hole 38 located in the middle of the pad 36 extends through the printed circuit board 20 to the Y1 conductor imprinted on the bottom surface 24 of the printed circit board. The plated-through hole 38 and the pad 36 form an electrical terminal for the conductor Y1 on the top surface 22.

Figure 4:
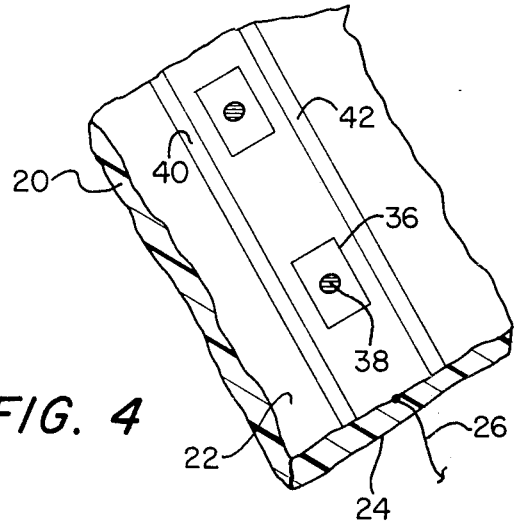
FIG. 4 is a detailed illustration of an alternative conductive means.
Figure 5:
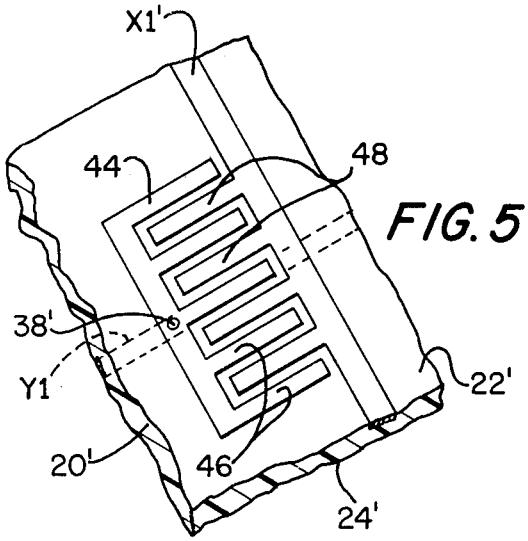
FIG. 5 is a detailed illustration of yet another alternative conductive means.

It is to be appreciated that the configurations of both the X conductor and the pad 36 on the surface 2 can vary within the scope of the invention. Referring to FIG. 4, the X1 conductor with its individual open rectangles is replaced by a pair of parallel conductors 40 and 42. A variation in both the pad 36 and the X1 conductor is illustrated in FIG. 5. A pad 44 on the top surface 22′ of the printed circuit board 20′ contains a plurality of fingers 46 which are interspersed in a closely-spaced relationship with fingers 48 extending from the X1′ conductor. The pad 44 being connected through the Y1′ conductor via the plated-through hole 38′, establishes a Y terminal on the surface 22′ which is touch-sensitive over a broad area. As will become apparent hereinafter, this touch sensitivity over a broad area is attributable to the local conductivity of the electrically-conductive layer 18 in combination with a spacing of the Y terminal with respect to the X conductor.

Figure 6:
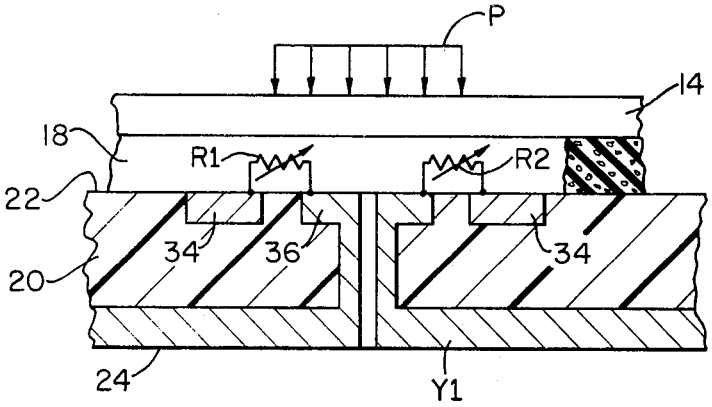
FIG. 6 is a cross-sectional view of the conductive means of FIG. 3.

Having now described various terminal configurations for the Y conductor on the top surface 22 and moreover having described how an X conductor can be configured relative thereto, it is now appropriate to examine how the electrical paths are established between these two top surface elements. The electrical paths between the open rectangle 34 and the pad 36 of FIG. 3 are established through the electrically conductive layer 18. This is illustrated in FIG. 6 by the resistive paths R1 and R2 which are variable depending on the pressure P applied through the layer 14 to the electrically conductive layer 18. In order for the resistance to be variable in the electrically conductive layer 18, it is preferable that the electrically conductive material be a vary poor electrical conductor when unstressed and be a reasonably good conductor when subjected to local pressure. It is moreover preferable that the electrically conductive material be sufficiently flexible so as to only be locally compressible. The electrically conductive material should also be isotropically conductive, i.e. conductive in all directions.

An electrically conductive material with the aforementioned properties could be an elastomer embedded or otherwise impregnated with electrically conductive particles. The pressure sensitive electroconductive elastomer utilized in the preferred embodiment of the present invention consisted of a silicon rubber embedded with silver particles such as is illustrated by the partial section of the electrically conductive layer 18 in FIG. 6. This material had a normally high resistance in the mega ohm range, and a resistance of 5 to 10 ohms when subjected to a normal finger pressure of approximately 15 pounds per square inch. This particular pressure sensitive, electroconductive elastomer can be obtained from Dynacon Industries, Leonia, N.J.

It is to be understood that an appropriate spacing must be maintained between the pad 36 and the open rectangle 34 in order to establish the resistive paths through the electroconductive layer 18. For the abovementioned pressure sensitive electroconductive material, it has been determined that a spacing between two thousandths of an inch and twenty thousandths of an inch was adequate. This would mean the inner perimeter of the open rectangle 34 should be spaced at least two thousandths of an inch not more than twenty thousandths of an inch from the pad 36.

Figure 7:
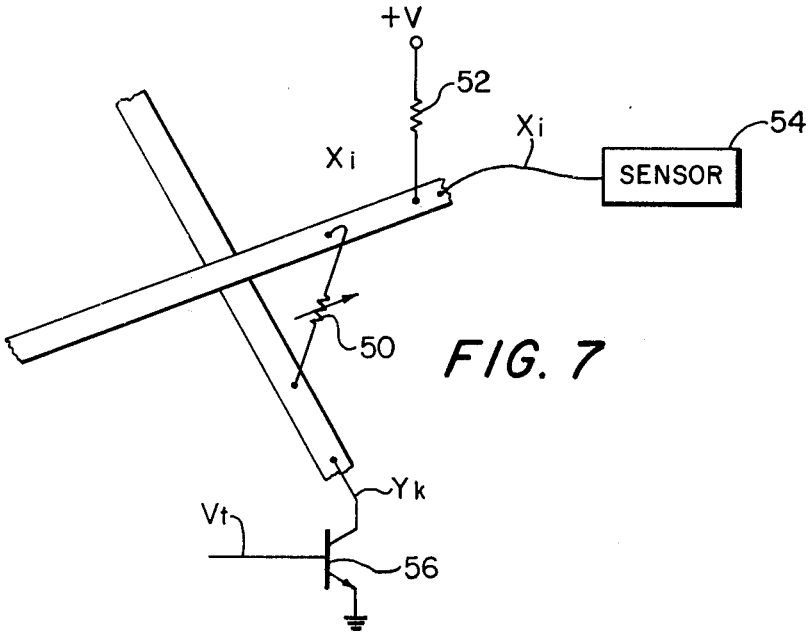
FIG. 7 is an electrical schematic depicting the conductive means of FIGS. 3 and 4.

Having now described the manner in which a low resistance electrical path is established between an X and a Y conductor, it is now appropriate to turn to FIG. 7 which schematically depicts the manner in which this electrical path can be identified. It is to be understood that a complete data entry system including the electrical path herebefore disclosed is the subject of U.S. application Ser. No. 625,240, entitled, "Data Entry System", filed Oct. 23, 1975 in the names of Joseph J. Eachus, Theodore S. Graff and Douglas H. Seggelin. The ensuing discussion illustrates how the electrical path characteristics of the touch sensitive device an be effectively utilized in such a data entry system.

The electrical path in FIG. 7 is seen to occur between a conductor $X_i$ and a conductor $Y_k$. It is to be understood that the subscripts i and k denote any particular X and Y strip on the printed circuit board 20. As has been previously explained, each $X_i$ conductor is resistively connected to each $Y_k$ conductor passing underneath by a variable resistance 50. This variable resistance 50 is synonomous with the variable resistances R1 and R2 of FIG. 6.

The $X_i$ conductor is moreover attached through a high resistance 52 to a power supply voltage V. The variable resistance 50 will normally also be extremely high so that there will be negligible current present in the $X_i$ conductor. This current condition will be logically equivalent to a binary one which will be sensed by a sensor 54 attached to the X conductor. The logical state indicated by the current condition present on the X conductor strip changes when: (1) a low resistance path is established through the variable resistance 50, and (2) the $Y_k$ conductor is grounded. This latter condition occurs when a transistor 56 connected to the conductor strip $Y_k$ is caused to conduct. This is accomplished by applying an appropriate test signal voltage $V_t$ to the base 58 of the transistor 56. If pressure has been applied to the particular location defined by the $X_i$ and $Y_k$ conductors, then the variable resistance 50 will be low thereby causing conduction from the power supply voltage V through transistor 56 to ground. The resulting current condition in the conductor $X_i$ will indicate a logical zero condition to the sensor 54. As will be explained in detail hereinafter, when the sensor 54 indicates a logical zero, a particular location on the touch sensitive device 10 can be identified by the location identification device 12.

In order to allow the $X_i$ conductor to register a logical zero at the sensor 54, it is necessary to carefully define the minimum necessary current through the variable resistance 50. This is in large part dependent upon the amount by which the variable resistance 50 changes when subjected to pressure. For a variable resistance normally in the mega-ohm range, which subsequently changes under pressure to at least 100 ohms, the value of the high resistance 52 is preferably set at 8700 ohms for a power supply voltage of +5 volts. It is to be noted that the preferred cut-off of 100 ohms is substantially greater than the known 5–10 ohm resistivity of the pressure sensitive variable resistance material when subjected to human finger pressure. The 100 ohm cut-off insures detection of a location not experiencing full fingertip pressure.

Figure 8:
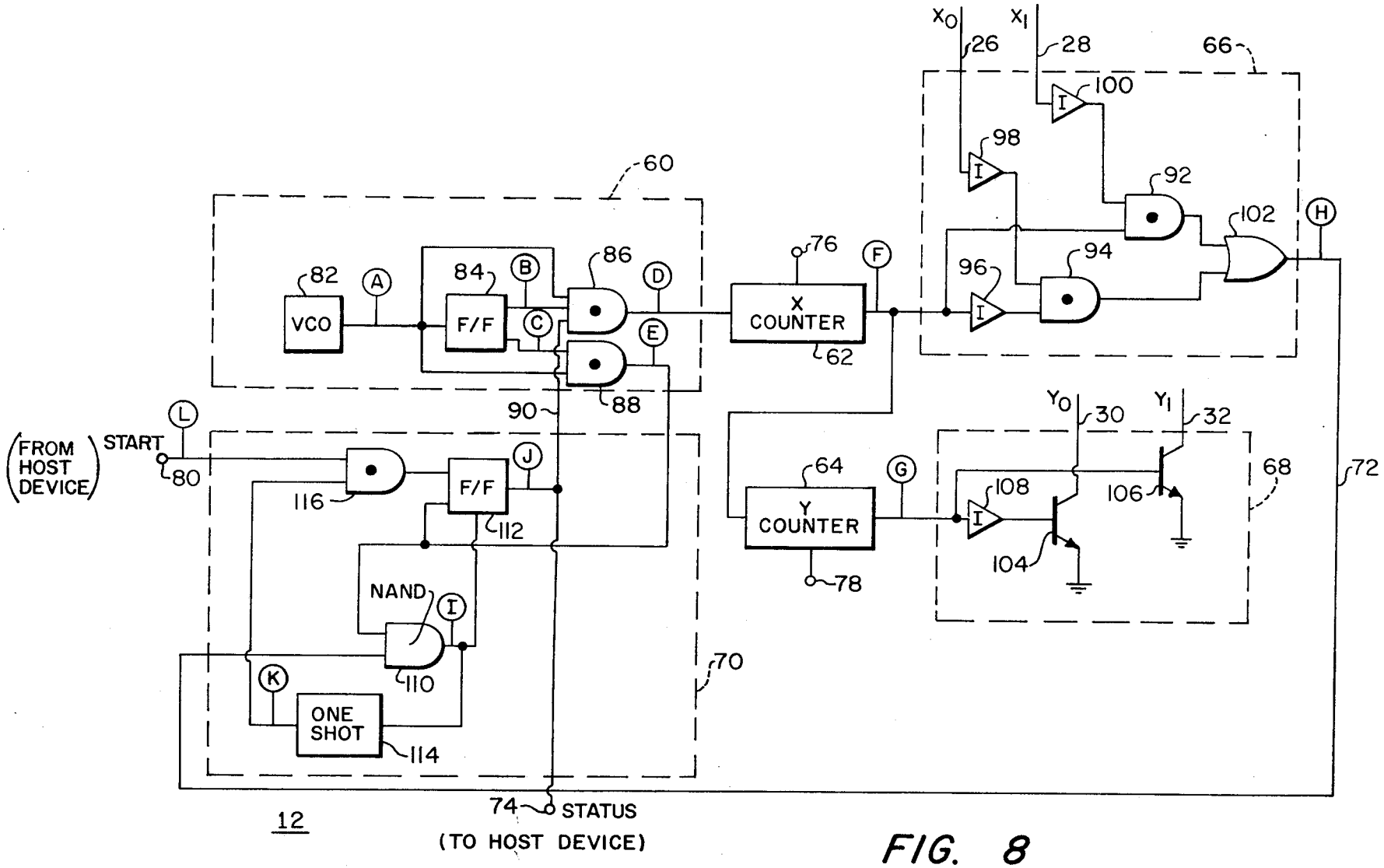
FIG. 8 is a detailed illustration of the location identification device of FIG. 1.

Having described the touch sensitive device 10, it is now appropriate to turn to a description of the location identification device 12 which is illustrated in detail in FIG. 8. It will be remembered that the location identification device 12 is connected to the X and Y conductors of the touch sensitive device via the lines 26–30. These particular line connections are illustrated in FIG. 8. The location identification device 12 sequentially tests the X and Y conductors through these lines so as to identify a particular location under pressure. This testing begins with a clock 60 driving an X counter 62 that in turn drives a Y counter 64. The X counter 62 sequentially activates gates within a sensor 66 which sense the signal levels of the X conductors applied thereto. At the same time, the Y counter 64 sequentially grounds the Y inputs to a Y testing means 68. If a particular location has been depressed, the X sensor 66 will detect a logical zero on the particular X conductor that identifies the location when the $Y_i$ conductor identifying the location is being sequentially tested by the Y testing means 68. At this time, the X sensor signals a status network 70 via a line 62 that a depressed location has been found. The status network 70 disengages the clock 60 thereby freezing the X count and Y count. The status network 70 furthermore indicates at a status terminal 74 that a depressed location has been detected and the X and Y digital coding for the location is available at terminals 76 and 78 of the X and Y counters. The status network 70 is finally operative to prevent the initiating of any further testing until an appropriate amount of time has lapsed from when the X sensor 66 first went high. This latter function effectively disables any further start initiation at a terminal 80.

Having now described the overall functioning of the location identification device 12, it is now appropriate to turn to a specific discussion of the various elements previously outlined above. In this regard, reference will also be made to various signal waveforms in FIG. 9, which occur at the various alphabetically labelled locations in FIG. 8.

Figure 9:
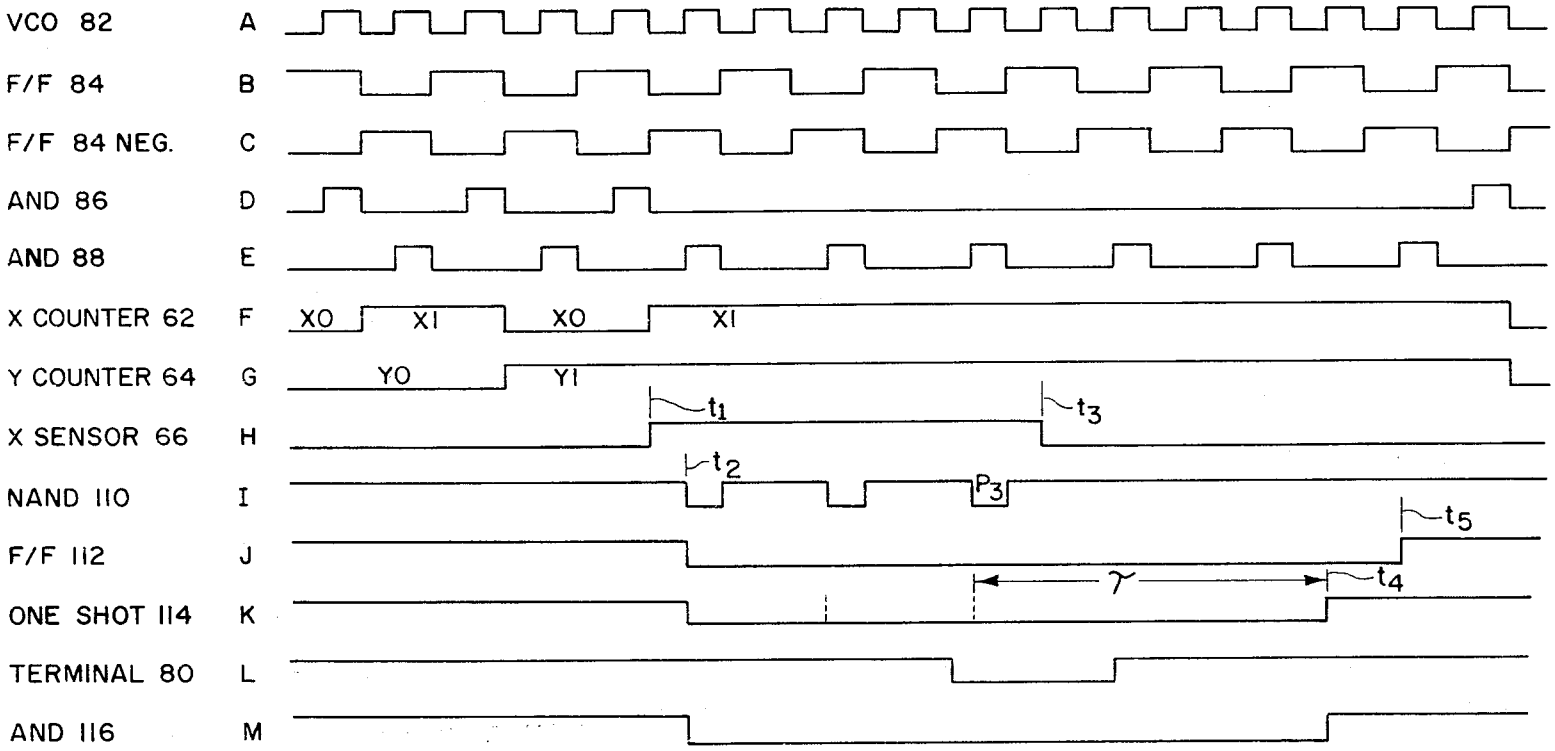
FIG. 9 is an illustration of various signal conditions present within the location identification device of FIG. 6.

The clock 60 begins with a voltage controlled oscillator 82 which produces a VCO waveform A in FIG. 9. The VCO signal A is frequency divided by a flip-flop 84 so as to generate the extended VCO signal waveforms B and C indicated in FIG. 9. The extended VCO signals B and C are combined with the original VCO signal A at the AND gates 86 and 88. The AND gate 86 will produce a count signal D when the signal from the status network 70 appearing on a line 90 is logically high. The AND gate 88 on the other hand continually produces a signal E for the status network 70.

The count signal D from the AND gate 86 provides a count cadence to the X counter 62. Referring to FIG. 9, the output signal F of the X counter 62 toggles on successive trailing edges of each pulse of the count signal D. The output signal F is in turn applied to the Y counter 64 which toggles on successive trailing edges of the X count signal F as is shown by waveform G. In this regard, the Y count will remain constant while the successive X counts are made. This means that the X count will first be binary zero and then binary one indicating the conductors $X_0$ and $X_1$ of FIG. 2 for a given Y count. It is to be understood that the X count could be further extended to include multiple outputs indicative of higher ordered binary counts. The Y count could similarly reflect larger numbers of Y conductors.

Depending on the binary value of the X count, either an AND gate 92 or an AND gate 94 are enabled withiin the X sensor 66. This is accomplished by virtue of the signal from the X counter being applied directly to the AND gate 92 and being first inverted through an inverter 96 and thereafter applied to the AND gate 94. Each AND gate when enabled senses the inversion of the signal level present on a respective X conductor. The inversions of the X signal levels are accomplished through a set of inverters 98 and 100 as shown.

As has been previously explained with regard to FIG. 7, an X conductor will be logically low if pressure has been applied to a particular location definable by that X conductor having a Y conductor crossing underneath which has been grounded. When such occurs, the particular AND gate within the X sensor 66 will go logically high when enabled by the binary count signal from the X counter 62. The resulting signal output from either the AND gate 92 or the AND gate 94 is applied to an OR gate 102. The output of the OR gate 102 is in turn applied to the status network 70 over the line 72.

Before the signal level on a particular X conductor can go low, it is necessary that the Y conductor passing underneath the location experiencing pressure be appropriately grounded. This is accomplished by the Y testing means 68 which comprises a plurality of transistors such as 104 and 106. The collectors of each of these transistors is respectively connected to either a line 30 or 32 which in turn connects to a particular Y conductor of the printed circuit board 20. The base of the transistor 106 is directly connected to the output of the Y counter 64 whereas the base of the transistor 104 is connected through an inverter 108 to the output of the Y counter. The transistors 104 and 106 are sequentially made conductive by virtue of the Y count as defined by signal G.

To briefly summarize the above, the Y testing means 68 will sequentially ground the Y conductors on the printed circuit board 20 while the X sensor 66 will sequentially sense the signal level of the various X conductors. When the X and Y conductors identifying a particularly depressed location are simultaneously grounded and sensed, then the X sensor 66 will produce a logically high signal on the line 72. The signal present on the line 72 is identifiable by the waveform H in FIG. 9.

The above sequence of events is depicted in FIG. 9 wherein the waveforms F and G of the X and Y counters are seen to sequentially define the count of the location being tested. When the location defined by the crossing of the X1 and Y1 conductors is encountered at time $t_1$, the X sensor 66 goes high as is indicated by the signal H. The location which was thus depressed in FIG. 1 has now been identified in terms of an X and a Y count.

Referring now to FIG. 8, it is to be noted that the output signal from the X sensor 66 is applied over the line 72 to a NAND gate 110. The NAND gate 110 also receives the output signal E from the AND gate 88 within the clock 60. The NAND gate 110 goes low in response to both the signal H from the X sensor 66 and the signal E from the AND gate 88 being simultaneously logically high. This low signal level output from the NAND gate 110 resets a flip-flop 112 so as to cause the output signal J from the flip-flop 112 to go logically low. The output signal J from the flip-flop 112 constitutes the status level output for the status network 70. The status level output is made available to the clock 60 over a line 90 while the same is made available to a host device at a terminal 74. A logically low signal level from the status network 70 disables the AND gate 86 within the clock 60 so as to thereby discontinue the count signal D which in turn feezes X count and Y count present in the X counter 62 and the Y counter 64. At the same time, the logically low signal level present at the terminal 74 indicates to the host device that a depressed location has been identified and the location code therefore is present in the X counter and Y counter.

The above operation of the status network 70 is fully depicted in FIG. 9 wherein the output signal I of the NAND gate 110 is seen to go low at time $t_2$ in response to signals E and H being simultaneously high. This resets the flip-flop 112 low at time $t_2$ as is indicated by the waveform J in FIG. 9. The waveform J, representing the output signal condition from the status level network 70 disables the AND gate 86 within the clock 60. This is illustrated by the waveform D remaining low after time $t_2$. With the count signal waveform D low, the X and Y count within the location identification device are thus frozen.

The status network 70 maintains the location identification device 12 in this frozen condition as follows. A one-shot 114 is operative to provide a low signal level to an AND gate 116 in response to a low signal level from the NAND gate 110. This is illustrated in FIG. 9 by the waveform J which goes low at time $t_2$ in response to the logically low signal level of signal I. The one-shot circuit 114 is timed to remain logically low for a time period $\tau$ which is more than sufficient for the X sensor 66 to indicate the removal of pressure from the particularly depressed location on the device. The one-shot 114 is moreover continually reset by the NAND gate 110 as long as the X sensor 66 indicates that the particularly identified location is still depressed. The NAND gate 110 continually goes low in response to the clock pulse. signal E periodically going high. The dotted resets of the one-shot circuit 114 occurring each time the NAND gate goes low are illustrated in the waveform K in FIG. 7. This continually occurs until a time $t_3$ wherein the signal H from the X sensor 66 goes logically low thereby indicating the removal of pressure from the touch sensitized location. The one-shot circuit 114 will thereafter continue to disable the AND gate 116 for a time $\tau$ following the last inverted pulse $P_3$ in the signal I from the NAND gate 110. It is not until a time $t_4$ that the AND gate 116 will become enabled so as to be capable of transmitting a logically high signal to the flip-flop 112. The latter event will occur when an appropriate START signal from the host device is provided to the terminal 80 of the status network. This is indicated by the signals L and M in FIG. 9 wherein the terminal 80 is normally logically high except during the time in which the digitally coded location present on the X and Y counters is being received by the host device. The AND gate 116 on the other hand will only go logically high at the time $t_4$.

The flip-flop 112 goes high at a time $t_5$ after the AND gate 116 has provided a logically high signal to the input thereof. The time $t_5$ is dictated by the leading edge of a clock pulse occurring in the clock signal E from the AND gate 88. At that time, the flip-flop 112 is clocked to follow the signal level from the AND gate 116 which is applied thereto. With the flip-flop 112 again going high, the AND gate 86 within the clock 60 is enabled thereby allowing the count signal D to begin again. The count signal D continually drives the X and Y counters until a new location on the touch sensitive device 10 has been depressed and subsequently defined by the appropriate X and Y count.

From the foregoing, it is to be understood that preferred embodiments of both the touch sensitive device 10 and the location identification device 12 have been illustrated. It is to be appreciated that both may be individually used within a data entry system. It is furthermore to be appreciated that certain elements of each may either be removed or substitutes may be found therefore without departing from the scope of the invention.

What is claimed is:

1. A touch sensitive device comprising:

a first layer of material having a plurality of denoted locations on a topmost surface;

a second continuous layer of variable resistance flexible material positioned thereunder, said variable resistance flexible material being pressure sensitive so as to normally be high in resistance when not under an externally applied pressure and low in resistance only at a location that has been subjected to externally applied pressure; and a third layer comprising a rigid circuit means for defining a plurality of touch sensitive locations said rigid circuit means being positioned underneath said second continuous layer of variable resistance flexible material, said rigid circuit means comprising:

a first plurality of parallel conductors oriented in a first direction and lying in a first surface of said rigid circuit means, each of said first plurality of conductors being in contact with said second continuous layer of variable resistance flexible material;

a second plurality of parallel conductors oriented in a second direction and lying on a second surface of said rigid circuit means; and at least one conductive terminal on said first surface for each of said second plurality of conductors, each conductive terminal on said first surface being spaced from a respective conductor lying on the first surface, each conductive terminal on said first surface moreover being in contact with said second continuous layer of variable resistance flexible material, said conductive terminals on said first surface combining with respective conductors lying on said first surface so as to define a plurality of potentially conductive paths through said second continuous layer of variable resistance flexible material said potentially conductive paths thereby defining a plurality of touch sensitive locations located underneath said plurality of denoted locations on the topmost surface of said first layer of material whereby application of a predetermined amount of externally applied pressure to a given denoted location will establish a conductive path thereunder.

2. The touch sensitive device of claim 1 wherein said variable resistance material is isotropically conductive.

3. The touch sensitive device of claim 2 wherein said variable resistance, isotropically conductive, material comprises an elastomer embedded with electrically conductive particles.

4. The touch sensitive device of claim 3 wherein said elastomer is a silicon rubber and said electrically conductive particles are silver particles.

5. The touch sensitive device of claim 1 wherein said rigid circuit means comprises a plurality of:

means, passing through said rigid circuit means, for electrically conducting current between a conductive terminal on said first surface and a conductor on said second surface.

6. The touch sensitive device of claim 5 wherein said plurality of means passing through said rigid circuit means for electrically conducting current between a conductive terminal of said first surface and a conductor on said second surface comprises:

metal-plated holes through said rigid circuit means for defining electrical circuitry, said metal-plated holes extending upwardly from said plurality of conductors on said second surface.

7. The touch sensitive device of claim 1 wherein said terminals on said first surface are equally spaced from respective conductors on said first surface so as to substantially define the same current paths through said layer of variable resistance material positioned thereabove.

8. The touch sensitive device of claim 1 wherein said conductors on said first surface each comprise a plurality of fingers in the vicinity of each terminal spaced therefrom, said spaced terminal also comprising a plurality of fingers interspersed with a plurality of fingers from said conductor on said first surface.

9. The touch sensitive device of claim 1 wherein the normally high resistance of said variable resistance material is at least one mega-ohm and the low resistance of said variable resistance material under an externally applied pressure of a human finger is at least five ohms.

10. The touch sensitive device of claim 1 wherein said variable resistance, pressure sensitive material is flexible relative to the rigid means for defining electrical circuitry said variable resistance material moreover being locally compressible when subjected to the touch pressure of a human finger.

11. The touch sensitive device of claim 1 wherein each conductor on said first surface completely encompasses at least one conductive terminal on said first surface.

* * * * *